United States Patent [19]

Nilsson

[11] Patent Number: 4,503,781

[45] Date of Patent: Mar. 12, 1985

[54] PREFABRICATED SHELF UNIT

[75] Inventor: Maths Nilsson, Hestra, Sweden

[73] Assignee: AB Ernol, Hestra, Sweden

[21] Appl. No.: 374,715

[22] Filed: May 4, 1982

[30] Foreign Application Priority Data

May 29, 1981 [SE] Sweden ..... 8103410

[51] Int. Cl.[3] ..... A47B 57/00

[52] U.S. Cl. ..... 108/64; 52/464; 108/114; 312/111

[58] Field of Search ..... 108/64, 114; 52/464, 52/461; 312/111, 140; 144/286 R, 286 A

[56] References Cited

U.S. PATENT DOCUMENTS

| | | | |
|---|---|---|---|
| 1,204,174 | 11/1916 | Magee | 108/114 |
| 2,231,261 | 2/1941 | Eustis | 108/114 X |
| 2,639,789 | 5/1953 | Rosenberg | 108/114 X |
| 3,877,764 | 4/1975 | Hillier, Jr. | 312/111 X |
| 4,105,351 | 8/1978 | Anderson | 108/64 |
| 4,287,697 | 9/1981 | Matsubara | 52/464 X |

FOREIGN PATENT DOCUMENTS

| | | | |
|---|---|---|---|
| 512025 | 4/1955 | Canada | 108/114 |
| 848413 | 1/1950 | Fed. Rep. of Germany . | |
| 848413 | 9/1952 | Fed. Rep. of Germany . | |
| 880050 | 6/1953 | Fed. Rep. of Germany . | |
| 1036103 | 9/1953 | France . | |
| 1199970 | 12/1959 | France . | |
| 1250595 | 12/1960 | France | 108/114 |
| 695125 | 5/1962 | Italy | 108/64 |
| 149413 | 3/1955 | Sweden . | |
| 149414 | 3/1955 | Sweden . | |
| 264253 | 1/1950 | Switzerland . | |
| 155358 | 7/1956 | Switzerland . | |
| 993417 | 5/1965 | United Kingdom | 108/111 |

*Primary Examiner*—James T. McCall

*Attorney, Agent, or Firm*—Burns, Doane, Swecker & Mathis

[57] ABSTRACT

The present invention relates to a prefabricated shelf unit having a number of vertical columns and an optional number of shelves fixed to the columns with each shelf supported by cross members fixed to the columns at various levels of the columns. The cross members are provided with recesses for the reception of the ends of the shelves. The cross members are provided with end portions having vertical projections which are received into corresponding grooves in the columns. The grooves may be parallel longitudinal grooves, one for each projection of the cross member or a single groove in which the cross members are provided in back to back fashion with the projection of each cross member fitting into the single groove.

5 Claims, 6 Drawing Figures

PREFABRICATED SHELF UNIT

The present invention concerns a prefabricated shelf unit which can be manufactured of relatively simple material with the usage of very few working stages, and which can subsequently be packed to form a very compact parcel, which can be quickly and simply assembled on site to form a steady and stable shelf unit.

A number of different types of prefabricated shelf units are already known, both exclusive processed types and simpler variants intended, for example, for stores, garages, basements, or as simpler children's furniture.

Where the simpler and cheaper types of shelf units are concerned, certain problems have arisen. On the one hand, the combination of the use of simple and cheap material and rational manufacture with the usage of only a few working stages. On the other hand, simple and convenient assembly of the shelf unit on site at the same time as the shelf unit has a good stability. The problems that have been especially difficult to overcome have depended upon the difficulties in maintaining such precision in manufacture, depending among other things upon changes in the dimensions of the timber used, that the assembly of the shelf unit has proceeded smoothly and that the shelf unit has been sufficiently stable after assembly. It has thus not been uncommon for certain of the assembly fittings included in a shelf unit construction of this kind to have been unfit for use on account of the aforementioned poor accuracy.

The purpose of the existing invention is to achieve a prefabricated shelf unit that can be manufactured on the basis of simple and cheap material, preferably wood, by a simple manufacturing process and employing only an insignificant number of processing stages, the finished shelf unit being at the same time simple to assemble and steady and stable after assembly.

This objective is achieved in accordance with the invention if the shelf unit, which comprises a number of vertical columns, a number of shelves fixed to the columns, each of which has at its ends cross members for interaction with the columns, is characterized by the cross members having recesses for the reception of the ends of the shelf material, by the columns and cross members having interacting engaging devices for fixing the columns and cross members in position, and by tensioning devices being arranged for the purpose of pressing columns and shelves against each other.

In order to avoid cross bracing or back to the shelf unit, and also in general terms to make it more stable, it is characterized in accordance with the invention that it is advisable for the cross members to have essentially vertical back surfaces, which preferably extend further in a vertical sense than the material of the shelves, for the interacting engaging devices in the columns and cross members to be formed of longitudinal grooves taken up in the columns, and of the ends of the back walls projecting beyond the cross members and received by the grooves.

The object of the invention is further characterized by the cross members having end surfaces for bearing against the columns, when the tensioning devices are preferably formed by screws which pass through openings in the columns and ends of cross members and thence into the material of the shelves.

SUMMARY

Prefabricated shelf unit with a number of vertical columns (1), an optional number of shelves (2) fixed to the columns each having at its ends cross members (4) fixed to the columns at optional levels.

The shelf unit is designed for rational manufacture based on simple and cheap material, preferably boards, and for assembly without the use of specially designed or fittings demanding precision, and in addition for good stability without the need for so-called X-bracing or backs.

The shelf unit is characterized by the cross members (4) having recesses (6) for the reception of the ends of the boards (3) of the shelves (2), in which connection the cross members have vertical projections at their ends (12). The projections are received into corresponding grooves (16) in the columns, either in separate grooves or two projections in each, with the webs (9) of the cross members back to back. The fixing organs, preferably screws (5), pass through the columns, through openings (15) in the ends of the cross members (10), and into the boards.

The invention will now be described in more detail with reference to the attached drawings. Of these, FIG. 1 shows in perspective an example of prefabricated shelf unit designed in accordance with the invention.

FIG. 5 shows in perspective one version of a vertical column included in the shelf unit, while

Figure 1:
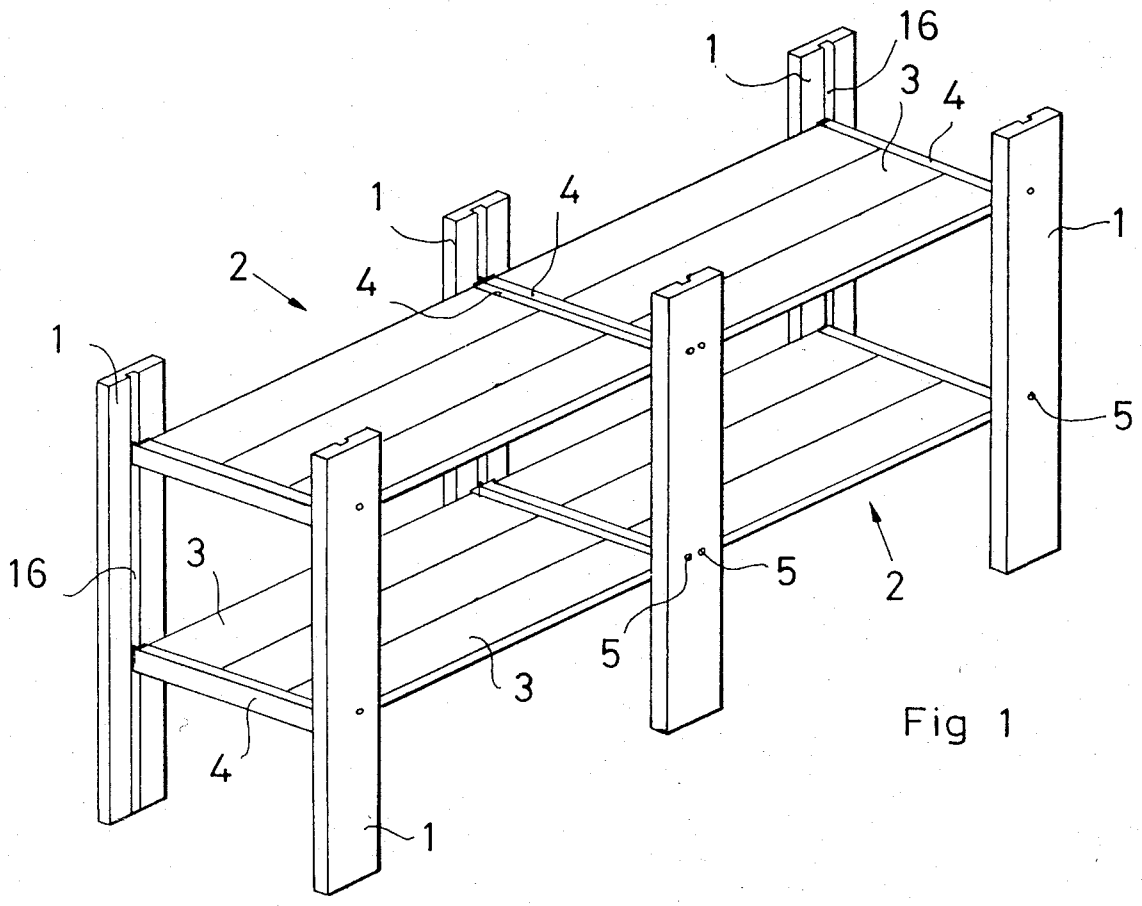

FIG. 1 shows an example of a shelf unit that is designed in accordance with the invention. Shelf units can naturally also be built in accordance with the invention with considerably more shelves above each other, and obviously also shelf units with a larger number of sections connected together to form a continuous length. Nor does the height of the shelf unit in accordance with the invention need to be the same throughout the whole length of such a long shelf unit. It can be seen from the figure that the prefabricated shelf unit comprises a number of vertical columns 1. As shown in FIG. 1, six vertical columns are provided as are two shelf units, each of which consists of two shelves 2. The boards 3 included in each shelf 2 are joined together mutually by means of cross members 4, which also contribute to the joining together of the shelves and the vertical columns. In addition to the cross members 4, the tensioning devices 5 are also used for this joining together, and they press the vertical columns in against the edges of the shelves and the ends of the cross members 4.

In accordance with the invention the prefabricated shelf unit is principally designed for manufacture in wood. Thus the vertical columns are made of planed wood, which is also the case with the boards 3 forming the shelves 2. Due principally to the design of the cross members 4, no excessive precision is demanded for the boards 3, which also to a certain extent applies to the vertical columns 1. Thus the whole shelf unit can be produced starting from relatively cheap wood, unless the use of position of the shelf unit makes other demands upon the quality of the wood. In accordance with the invention it is also naturally possible to manufacture the shelf 2 of panel material, in which case one need only pay slight regard to the design of the cross members 4.

Figure 3:
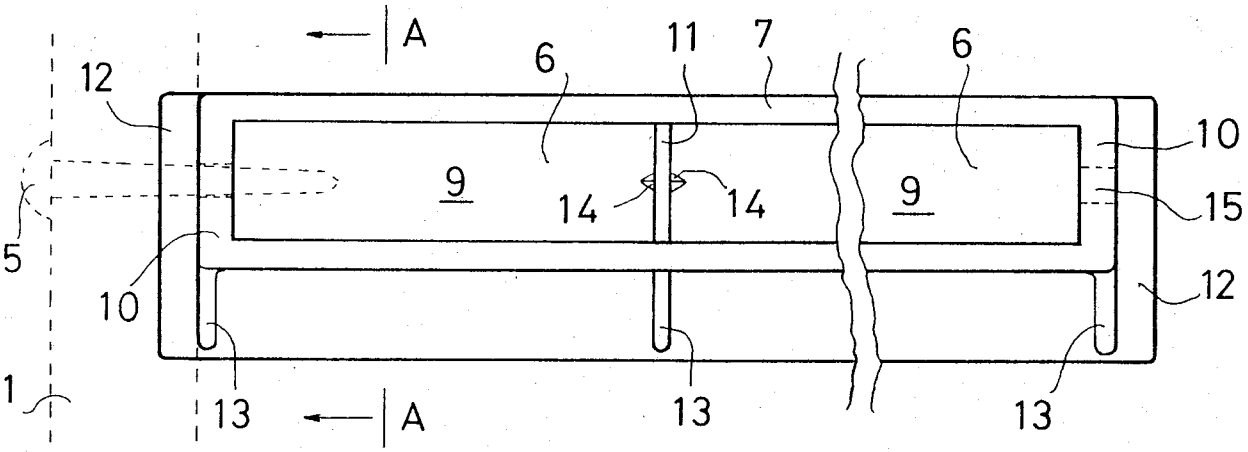
FIG. 3 shows a cross member included in the invention object, in which this is seen in the direction from the shelf towards the cross member.
Figure 4:
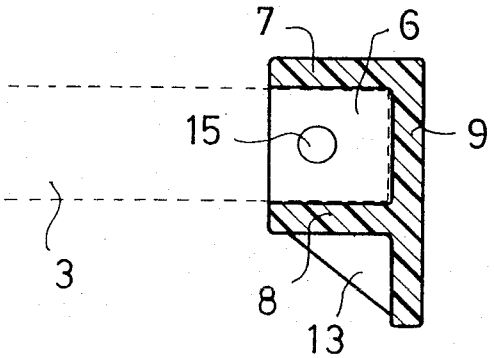
FIG. 4 shows a cross section along the section line A—A in FIG. 3.

FIGS. 3 and 4 show how the cross members are formed and also give indications as to how these work together with the vertical columns 1 and the boards 3. From FIG. 4 it can be seen that the cross members have longitudinal upper and lower flanges, 7 and 8 respectively, which are in close contact with the upper and lower sides respectively of a board. The cross members 4 furthermore have a rear web 9, wherewith the upper and lower flanges and the rear web together form a number of recesses 6, which with relatively tight fit receive the ends of the boards that form part of the shelves 2. The cross members 4 have furthermore end walls 10, plus a number of intermediate walls 11, which laterally, i.e. in the sense of the depth of the shelf unit, fix in position the boards that form part of the shelves 2.

As will be seen from the drawing, the cross members have the rear web extended downwards a bit below the lower flange of the cross member. This increasing height dimension of the cross members 4 has a twofold purpose: firstly to increase the strength of the cross members in the vertical direction, i.e. to assist the bearing capacity of the shelves 2: secondly to permit that extensions 12 of the rear web 9 can project beyond the end walls 10 and in this area have a relatively large vertical extent. In order to increase further the strength of the cross members, these also embrace a number of stiffeners 13, of which the outermost, i.e. those placed at the ends of the cross members, form a direct continuation of the end walls 10 of the cross members, which thus are plane, seen from the outside.

Since the shelves 2 consist principally of a number of boards 3, which at manufacture can have minor tolerances in dimensions and which after manufacture can dry out more or less and thereby shrink, especially in the direction of width, a requirement for play not to arise at the fixing of the boards in the cross members 4 is that at least the intermediate walls 11 are formed in a certain way. In accordance with the invention this is achieved by providing the intermediate walls 11 with one or more projecting, relatively sharp protuberances 14 which are forced into the wood when the boards are introduced into the recesses 6. As an alternative to the protuberances 14 shown on the drawing, the intermediate walls 11 in a central area can be provided with flexible sections which can be described as roughly Z-shaped. These flexible sections are capable in such case of taking up such deformations in the wood that occur during drying, but naturally can also be used to compensate to a certain extent for tolerances in the dimensions of the width of the wood.

In order to fix the cross members 4 to the vertical columns 1, in a way to be described below in detail, the end walls 10 also include openings 15 passing through them, through which the tensioning device 5 passes in the assembled state of the shelf unit.

In accordance with the invention the cross members 4 can with advantage be manufactured of a suitable plastic material, but metal of course can just as readily be used, and this can be of particular advantage in situations where the shelf unit must be designed to take heavy loads.

Figure 5:
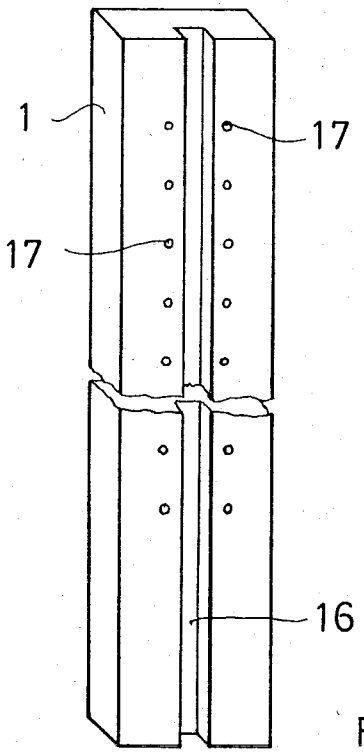
Figure 6:
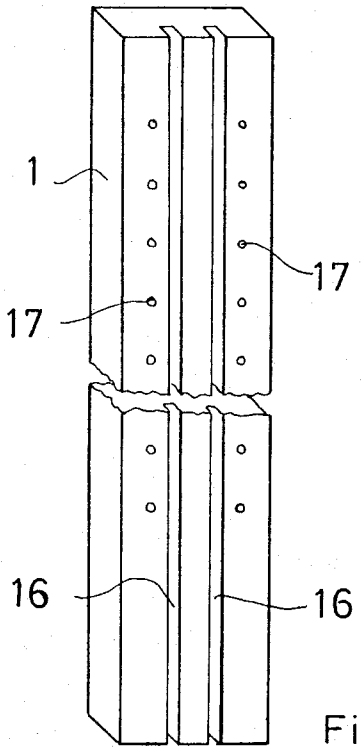
FIG. 6 shows, also in perspective, an alternative version of the vertical column.

FIGS. 5 and 6 show alternative versions of the vertical columns included in the shelf unit. In accordance with the invention these are preferably made of planed wood, but can of course also be made of plastic or metal, when for example extruded aluminium profiles could be a competitive alternative. As can be seen from the drawings the vertical columns 1 have an essentially rectangular section and have on one side a longitudinal groove 16, which as executed in FIG. 5 has such a width that with close fit both of the extensions 12 of two horizontal cross members 4 back to back can be accommodated. Furthermore the depth of the groove is such that the whole extension 12 can be accommodated in the groove, when possibly the end of the extension can touch the bottom of the groove. In addition two series of holes 17 are arranged alongside the groove, and they are so placed that they can coincide with holes 15 in the cross members 4 introduced into the grooves 16. By this means the cross members 4 will thus be able to be fixed in a number of alternative positions along the length of the vertical columns 1. Regarding the tolerances of the holes 17 and 15 it can be said that these are not particularly critical, since the walls limiting the holes are in themselves not load-bearing nor do they contribute to the stability of the shelf unit, and therefore it is sufficient that the precision is such that only the aforementioned fixing device can be introduced into the hole.

The version of the vertical column shown in FIG. 6 has two parallel longitudinal grooves, both of which have the same depth as the groove in the version shown in FIG. 5 but which have only half the width, where thus the projecting extension 12 on one cross member will be accommodated in each groove. This version of the vertical column 1 is especially advantageous in such situations where the shelves 2 in a complete shelf unit are not necessarily situated at the same height, and thus the back webs 9 of the cross members 4 cannot support each other. Furthermore this type of vertical column can also be suitably employed at the ends of shelf units, where an adjacent cross member is missing.

Figure 2:
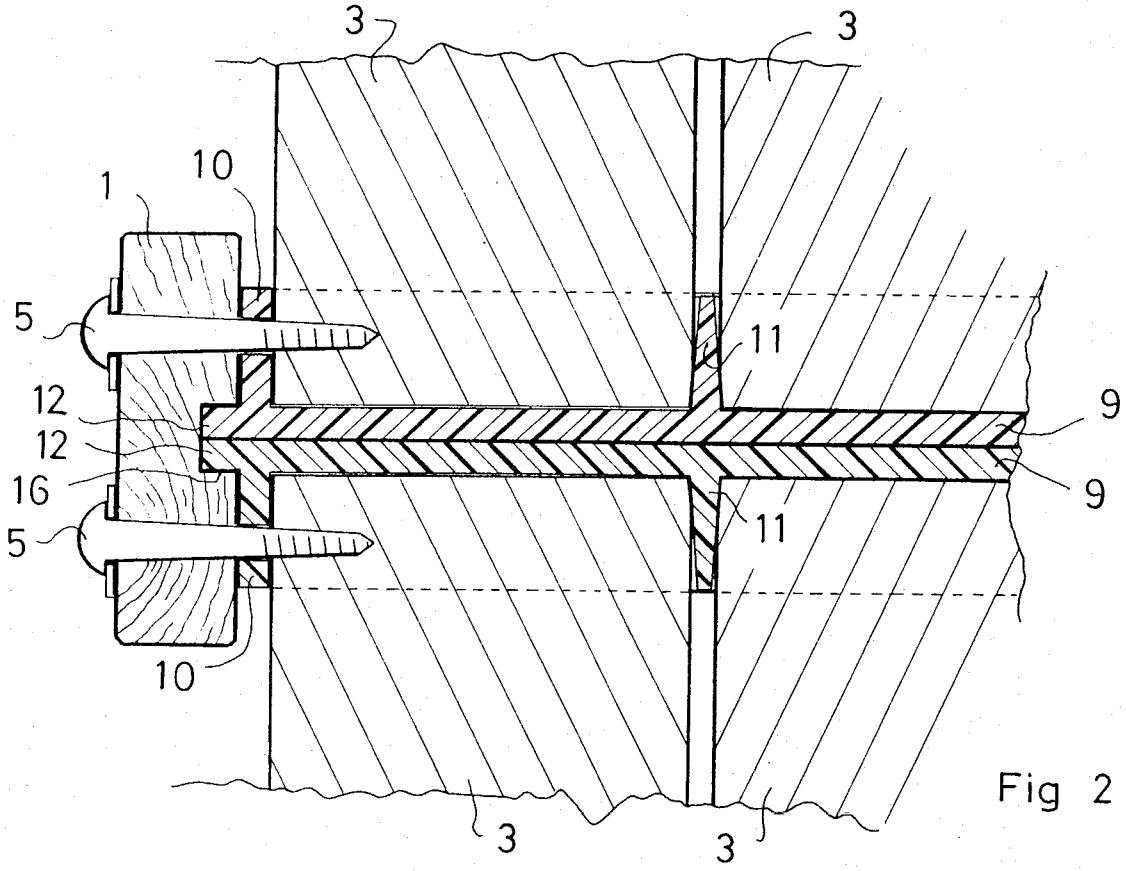
FIG. 2 shows a horizontal part section between two adjacent shelves and a vertical column.

FIG. 2 gives a schematic view of a horizontal section through a vertical column and through two shelves in the shelf unit together with the cross members 4 supporting these shelves. It can be seen from the diagram that the rear webs 9 of two cross members are placed back to back, and thereby the two extensions 12 of the rear webs 9 together form a width which fits into the groove 16 of the vertical column 1. It can further be seen that the end walls 10 of the two cross members will lie in a common plane in contact with one side of the vertical column 1. Accommodated in the recesses that are formed in the cross members 4 can also be seen the ends of 4 boards 3 which are included in two adjacent shelves in the shelf unit. From this it will be observed that the boards 3 fit tightly into the recesses, especially in the width sense of the boards 3, in which connection this tight fit is at any rate in part achieved by the forming of the intermediate walls 11 with the protuberances 14 arranged thereon.

In order to hold together the complete shelf unit, a number of tensioning devices 5 are used, which in the version shown consist of conventional wood screws or so-called French screws. These screws pass with free fit through the holes 17 in the vertical columns 1 and the holes 15 in the end walls 10 of the cross members, there with their threaded sections to bite into the ends of the shelf boards 3 situated nearest to the columns 1. By this means the boards themselves will thus be pressed against the columns, in consequence of which the end walls 10 and the extensions 12 will be enclosed between the boards and the columns. Due to the large contact areas between the end walls 10 of the cross membrs and the columns, good stability of the shelf unit design will be achieved with regard to tilting movements between columns and cross members. This gives good stability to the shelf unit design, inter alia in the depth sense. Furthermore, by the fitting of the extensions 12 into the grooves 16, very good locking of the cross members 4 is achieved in the torsional sense about the longitudinal axis of the tensioning device 5. In this way, deflections of the shelves will be prevented when these are loaded, but above all it will be possible to avoid cross bracing at the rear of the shelf unit or the use of completely enclosed backs to the shelf units.

As has been indicated above, the shelves do not need to be manufactured on the basis of timber but in accordance with the invention panel material can also be used for the shelf 2. In such an alternative the panels can naturally be sawn up into strips, when such a strip will naturally replace a board 3. However the panel material can also be used whole corresponding to the shelf 2, when either recesses are made in the short ends of the shelves for the intermediate walls 11 in the cross members 4 or the intermediate walls are completely abandoned. Depending upon the nature of the panel material, the tensioning device must be suitably adapted. Thus the screws shown in FIG. 2 can hardly be used if the panel material is made of chipboard, for example. On the other hand, in such a situation the wood screw shown in FIG. 2 can be satisfactorily replaced by a machine threaded screw, which engages in a so-called locking pin, which is placed in the panel material at a safe distance from the column 1. This variant can also of course be used in the alternative described above where the shelves are made up of a number of boards 3.

The invention can be modified within the framework of the following claim.

I claim:

1. Prefabricated shelf unit comprising a plurality of vertical columns provided with recesses, a plurality of shelves fixed to the columns and a plurality of cross members for receiving end portions of the shelves, said cross members provided with projections extending into said recesses, wherein said cross members are provided with end wall portions contacting said columns, said end wall portions fixedly secured between the columns and the shelves by tensioning element means extending through the end walls to interconnect the shelves and the columns.

2. Prefabricated shelf unit in accordance with claim 1, wherein the cross members have substantially vertical backs extending further in height than the shelves, the projections provided on the cross members and formed from end portions of the backs projecting outside the cross members and by the recesses provided as grooves extending longitudinally of the columns.

3. Prefabricated shelf unit in accordance with claims 1 or 2, wherein the tensioning elements, preferably in form of screws, extend through preselected ones of openings in the columns, the openings being provided as series of openings.

4. Prefabricated shelf unit in accordance with claim 2, wherein the recesses in the columns are of a width providing a tight fit with the projections of the backs of at least two of said cross members when said cross members are positioned back to back, a series of holes are provided on either side of the groove for alternative positions of the shelves.

5. Prefabricated shelf unit in accordance with claim 2, wherein the columns have at least one groove of a width for the reception with tight fit of the projections of the back of at least one of the plurality of cross members, and alongside each groove a series of holes are provided for alternative positions of the shelves.

* * * * *